US008596202B2

(12) United States Patent
Rodet et al.

(10) Patent No.: US 8,596,202 B2
(45) Date of Patent: Dec. 3, 2013

(54) MOTORED BOGIE

(75) Inventors: Alain Rodet, Chalon sur Saône (FR); Jeffrey Rollerson, Marmagne (FR)

(73) Assignee: Alstom Transport SA, Levallois-Perret (FR)

( * ) Notice: Subject to any disclaimer, the term of this patent is extended or adjusted under 35 U.S.C. 154(b) by 233 days.

(21) Appl. No.: 13/086,923

(22) Filed: Apr. 14, 2011

(65) Prior Publication Data

US 2011/0253003 A1 Oct. 20, 2011

(30) Foreign Application Priority Data

Apr. 14, 2010 (FR) ..... 10 52830

(51) Int. Cl.
*B61F 5/00* (2006.01)

(52) U.S. Cl.
USPC ..... 105/133; 105/140; 105/201

(58) Field of Classification Search
USPC ..... 105/34.1, 133, 138, 139, 140, 171, 80, 105/185, 190.2, 201
See application file for complete search history.

(56) References Cited

U.S. PATENT DOCUMENTS 3,990,372 A * 11/1976 Eggert et al. ..... 105/135
4,170,945 A * 10/1979 Kayserling ..... 105/133

FOREIGN PATENT DOCUMENTS

| | | | |
|---|---|---|---|
| DE | 19515588 | C1 | 7/1996 |
| EP | 0263793 | A2 | 4/1988 |
| FR | 1316173 | A | 1/1963 |
| FR | 2491849 | A1 | 4/1982 |
| WO | 2005005220 | A1 | 1/2005 |

OTHER PUBLICATIONS

French Search Report, dated Dec. 1, 2010, in Application No. FA 735122/FR 1052830.

* cited by examiner

*Primary Examiner* — Zachary Kuhfuss
(74) *Attorney, Agent, or Firm* — Young & Thompson

(57) ABSTRACT

A bogie (1) for a railway vehicle includes a motor (4) having a casing (6) fastened to two beams (2) of the bogie, the motor shaft (12) being arranged parallel to these beams (2), secondary suspensions (14) and a weight-bearing crosspiece (16) resting on the secondary suspensions (14). The bogie (1) includes a set of end supports (24) and stops (26) arranged on the casing (6) of the motor (4) and on the weight-bearing crosspiece (16).

20 Claims, 5 Drawing Sheets

MOTORED BOGIE

Figure 1:
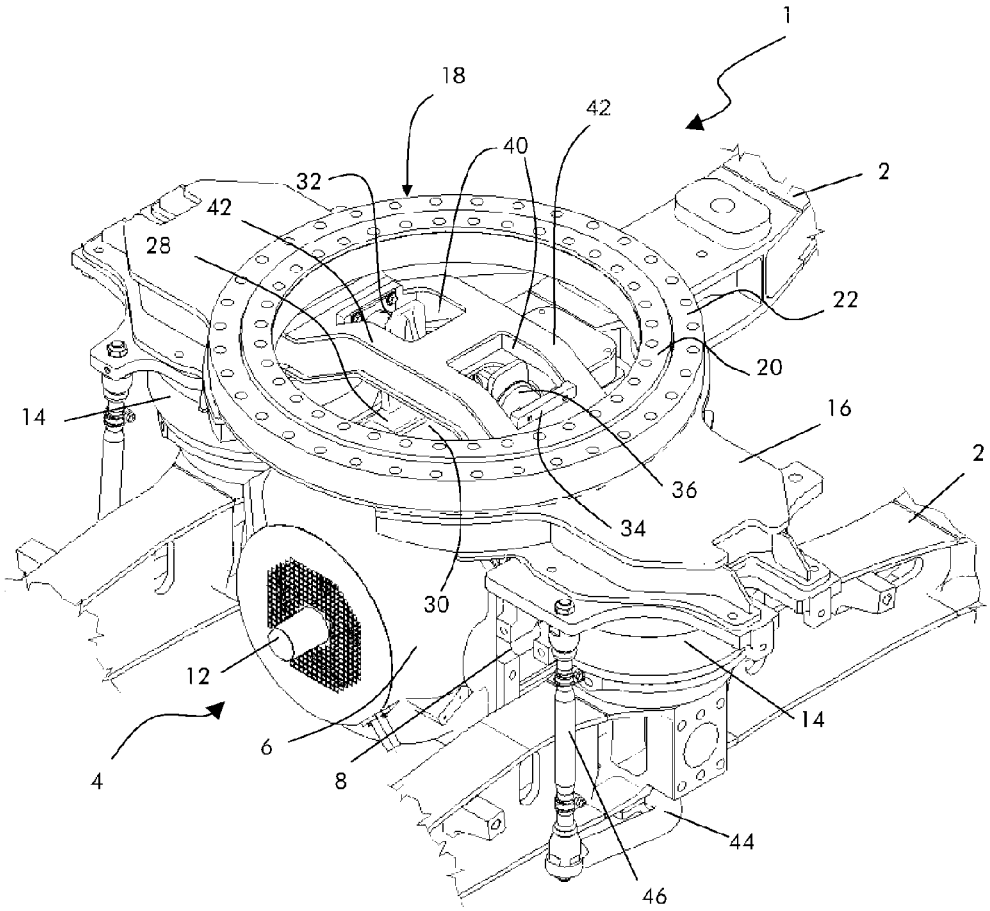

The present invention relates to a motored bogie for a railway vehicle including a device for limiting displacements.

The invention applies in particular, but not exclusively, to single-motor bogies for wheeled subways.

The device for limiting transverse displacements—also called lateral stops—serves to limit the transversal displacements and the rolling of the body of a railway vehicle relative to the bogie, for example when the vehicle crosses a curve. Indeed, the vehicle must fit all along the railway track in the transversal and vertical directions of a given track clearance, and the body of this vehicle must not move in the transversal direction or in the vertical direction more than the track clearance allows.

It is known that for a single-motor bogie comprising a longitudinal motor, a frame comprising two beams and two end cross-pieces, the casing of the motor is fastened in the central portion of the frame to the two beams of the bogie and its motor shaft is arranged parallel to said beams. The chassis also includes two lateral extensions, arranged towards the outside relative to the axes of the beams, to receive secondary suspensions. A weight-bearing crosspiece comprising a ball race, designed to support the body of a railway vehicle, rests on these secondary suspensions. Two end supports are arranged laterally on the beams, towards the inside relative to the axes of the beams, in the spaces between each secondary suspension and the motor. They cooperate during the rotation of the bogie around a longitudinal axis, with stops arranged under the weight-bearing crosspiece, which extend vertically towards the beams.

This bogie has the drawback of being bulky in the transversal direction due to the lateral offset of the secondary suspensions towards the outside of the frame. Moreover, the need to provide lateral extensions to support these suspensions makes the structure of the bogie frame more complex.

The present invention therefore aims to offset such drawbacks by proposing a bogie for a railway vehicle comprising a motor having a casing fastened to two beams of the bogie, the motor shaft being arranged parallel to said beams, secondary suspensions and a weight-bearing crosspiece resting on the secondary suspensions. Said bogie comprises an assembly of end supports and stops arranged on the casing of the motor and on the weight-bearing crosspiece.

The bogie of the invention can also meet at least one of the following features:

- an end support is formed by or includes an angle bracket having a base rigidly fastened on an outer part of the casing, and a support face extending in a plane substantially perpendicular to the base (alternatively, the end support is not necessarily in the specific form of an angle bracket, but a piece with a different shape, and, also, it may be made up of or include an attached piece fastened on the motor carcass in order to react the stresses),
- two end supports are rigidly fastened on the outer part of the casing situated above the motor shaft,
- a stop includes or is made up of a plate rigidly fastened to the portion of the weight-bearing crosspiece extending in a plane substantially perpendicular to the plane of the weight-bearing crosspiece towards the motor, and a rivet made from an elastic material fastened on said plate, the rivet having a substantially planar support face substantially parallel to the plate,
- two stops are rigidly fastened to a portion of the weight-bearing crosspiece, said portion being situated above the secondary suspensions,

- the support faces of the end supports are oriented towards the outside of the bogie, the support faces of each end support are oriented towards the inside of the bogie such that the support faces of the stops are arranged opposite support faces of the end supports,
- the secondary suspensions are arranged at the beams and substantially in the middle thereof,
- a stabilizer bar is arranged between the two beams and includes two connecting rods arranged on either side of the beams, connected to the weight-bearing crosspiece.

Figure 2:
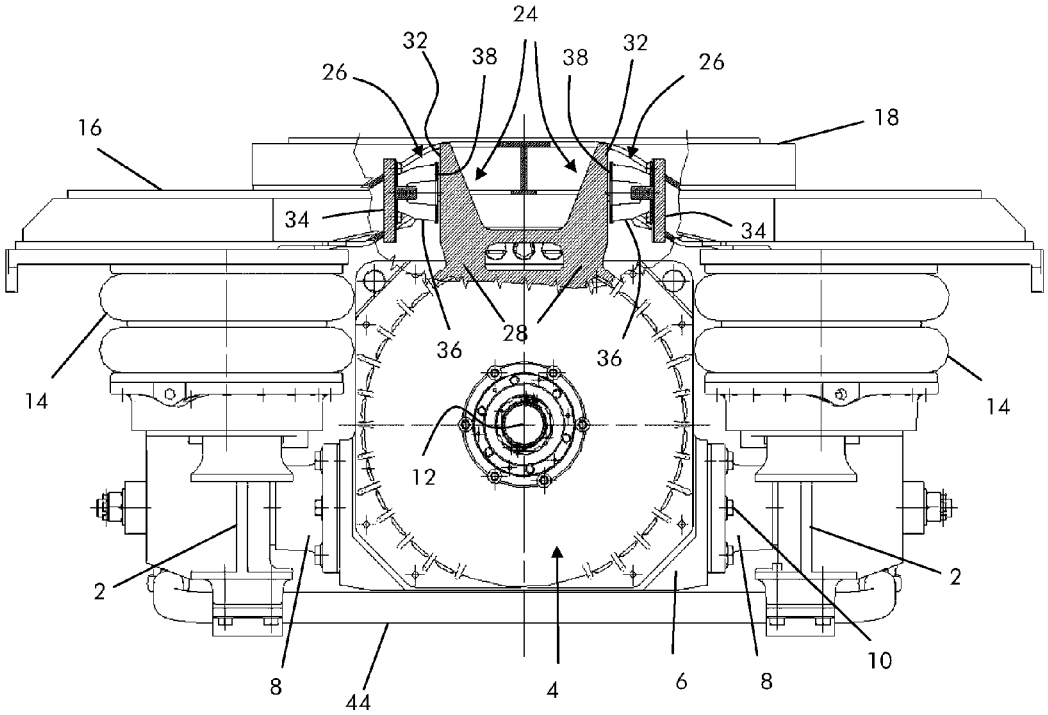
Figure 3:
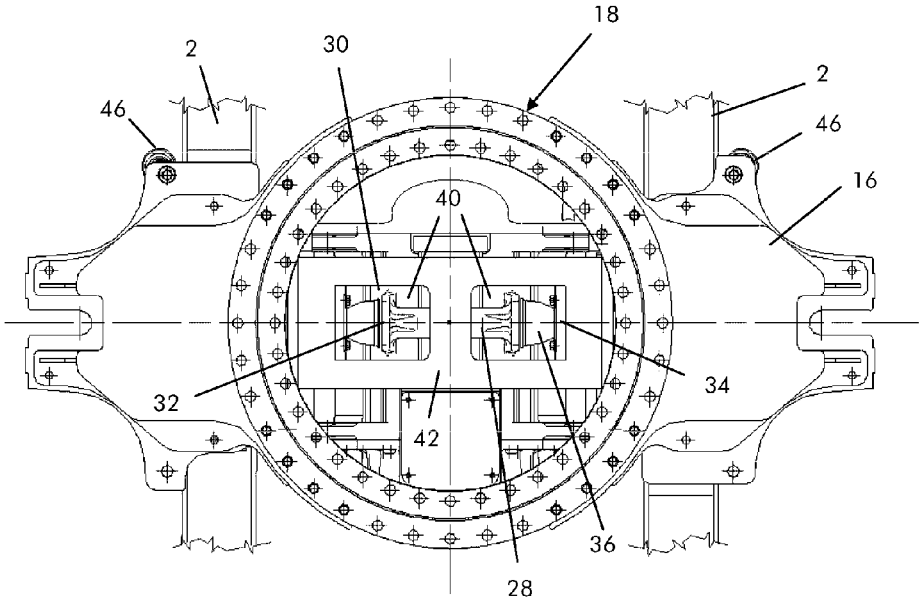
Figure 4:
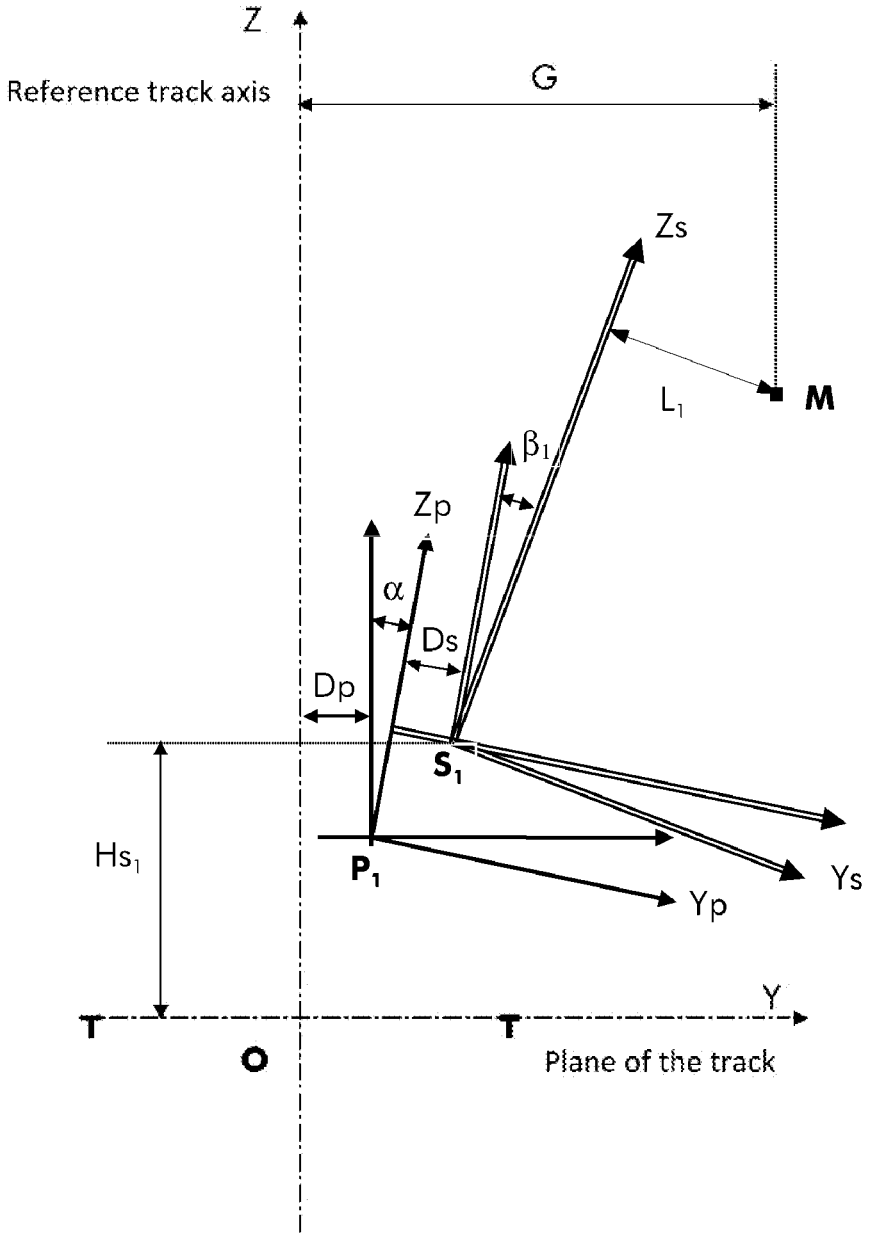
Figure 5:
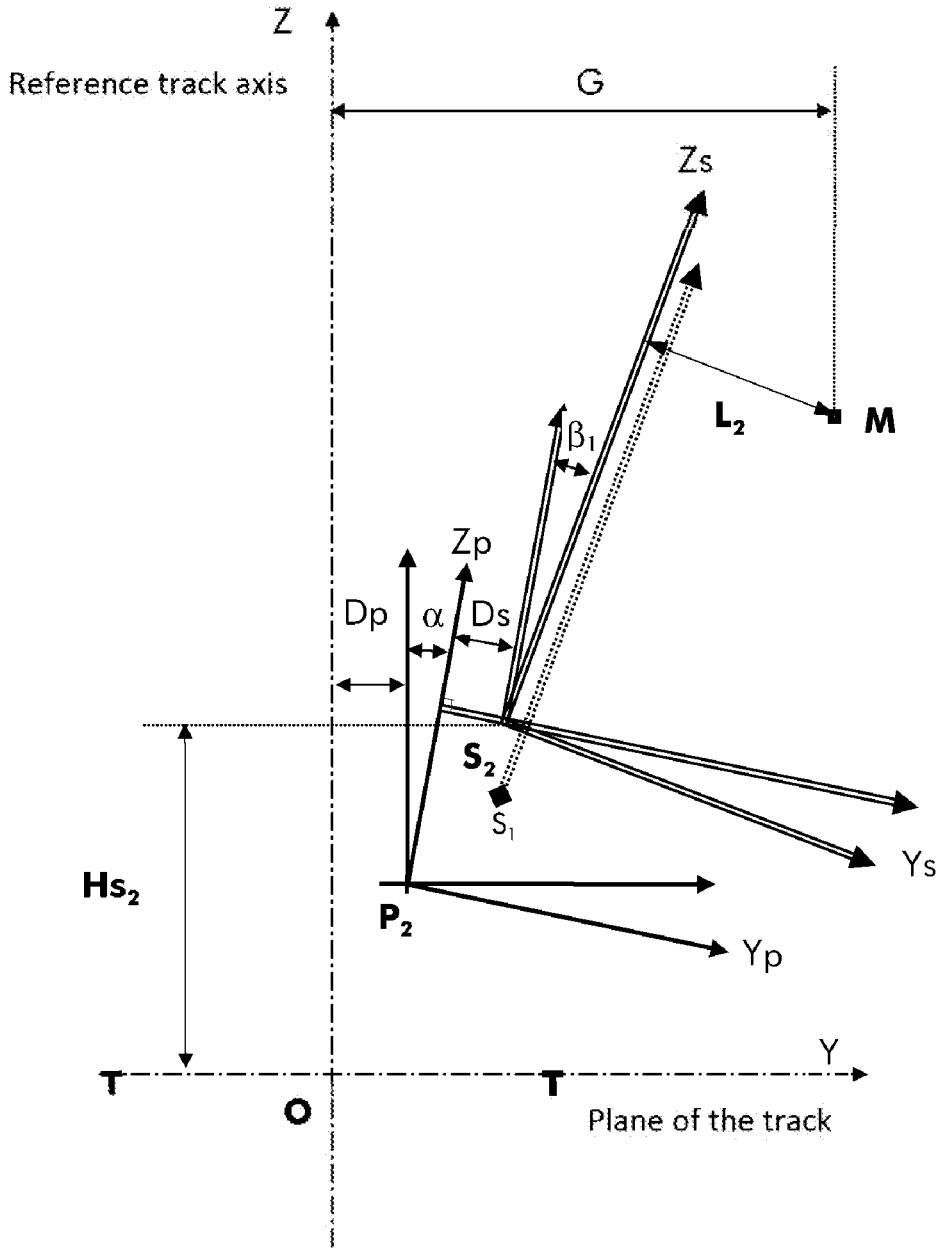
Figure 6:
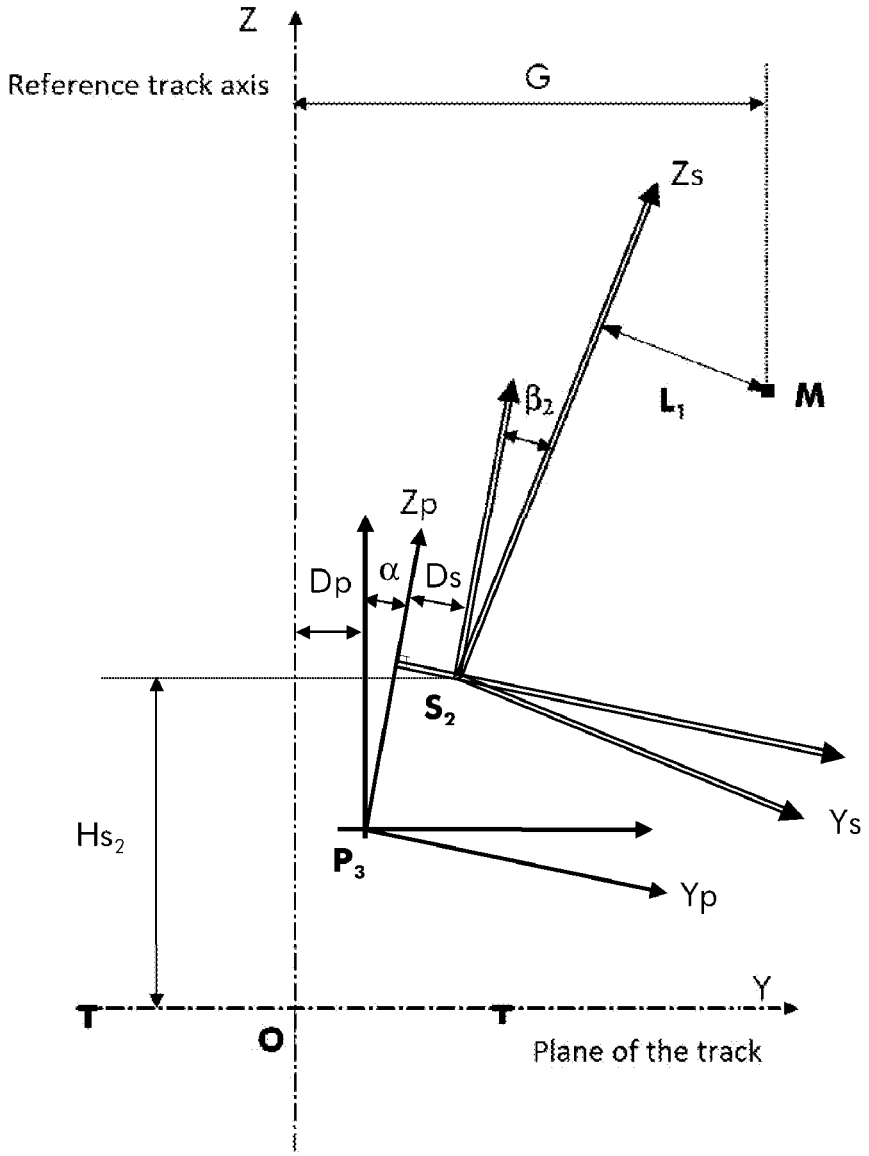

Other aims, features and advantages of the invention will appear upon reading the description of embodiments of the limiting device and the bogie, the description being done in relation to the drawings in which:

FIG. 1 is a partial perspective view of a motored bogie and the limiting device according to the invention, FIG. 2 shows a partial transverse view of the motor bogie according to the invention, the view partially including a transverse cross-section to show the limiting device according to the invention, FIG. 3 shows a partial top view of the motored bogie and the limiting device according to the invention, FIG. 4 shows a diagrammatic illustration in the transversal direction of a railway vehicle body resting on a bogie provided with a limiting device according to the state of the art, FIG. 5 shows a diagrammatic illustration in the transversal direction of a railway vehicle body resting on a bogie provided with a limiting device according to the invention, FIG. 6 shows a diagrammatic illustration in the transversal direction of a railway vehicle body resting on a bogie provided with a limiting device according to the invention and whereof the secondary suspensions are recentered in the transversal direction.

To facilitate reading of the drawings, only the elements necessary to understand the invention have been shown. The same elements bear the same references from one drawing to the next.

In the specification, the terms "vertical" and "horizontal" are defined relative to a railway vehicle body resting on at least one bogie. Thus, a horizontal plane XY is substantially parallel to the plane of the track and the vertical-longitudinal plane XZ is substantially parallel to the plane in which the wheels extend. The term "longitudinal" is defined relative to the direction in which the body of a railway vehicle extends in a horizontal plane and the term "transversal" is defined in a direction substantially perpendicular to the longitudinal direction in a horizontal plane.

FIG. 1 is a partial perspective view of the bogie according to the invention. The bogie 1 comprises two beams 2 extending in the longitudinal direction, a longitudinal motor 4, with an interior rotor. The casing 6 of the motor is fastened to the beams 2 on either side in the transverse direction by an interface part 8. This part is dimensioned so as to transmit the transversal stresses borne by the motor casing. FIG. 2 shows the fastening of said interface part 8 to the casing 6 using screws 10. The shaft 12 of the motor 4 is substantially parallel to the axis of the beams 2. A secondary suspension 14 is arranged approximately in the middle of each beam 2, in the longitudinal direction. Here it is made using a pneumatic suspension well known by those skilled in the art. A weight-bearing crosspiece 16 is arranged transversely and rests by its two transversal ends on the two secondary suspensions 14. It supports, in its center, a ball race 18, the inner race 20 of which includes fastening means capable of being rigidly fastened to the body of a railway vehicle, while the outer race 22 is rigidly fastened to the weight-bearing crosspiece 16. The upper surface of the ball race 18 defines a substantially horizontal support plane of the body on the bogie 1.

The device for limiting the transversal displacements between the bogie 1 and the body (not shown) comprises an end support 24 and stops 26 assembly, arranged on the casing 6 of the motor 4 and on the weight-bearing crosspiece 16. More precisely, in the example of FIGS. 1 to 3, two end supports 24 are rigidly fastened on the casing 6, while two stops 26 are rigidly fastened on the weight-bearing crosspiece 16.

Each end support 24 is in the form of an angle bracket having a base 28 rigidly fastened on an outer part 30 of the casing, arranged in the upper part above the motor shaft 12, substantially under the ball race 18. The base 28 is substantially parallel to the support plane of the body on the bogie 1, and a support face 32 extends in a plane substantially perpendicular to the base 28, towards the ball race 18, up to a height not exceeding the horizontal support plane of the body on the bogie. The support faces 32 are each oriented towards the outside of the bogie 1. The support of each stop thus has a right-angled triangular shape, the hypotenuse of which is oriented towards the center of the bogie 1.

Alternatively, the base 28 of each end support 24 could also rest on an outer part 30 of the casing 6 that is not strictly parallel to the support plane of the body on the bogie 1. This can be the case in particular when the casing 6 of the motor is cylindrical.

Each stop 26 is formed by a plate 34 extending in a plane substantially perpendicular to the support plane of the body on the bogie 1, and a rivet made from an elastic material 36 (for example rubber) fastened on said plate 34. The rivet has a substantially planar support face 38 parallel to the plate 34, oriented towards the inside of the bogie 1. The plate 34 is rigidly fastened to the inside of a recess 40 of a raised portion 42 of the weight-bearing crosspiece 16, the raised portion 42 being situated inside the ball race 18. The complete stop 26 (plate 34 and elastic rivet 36) is therefore arranged at a height greater than that of the support surface of the weight-bearing crosspiece 16 on the secondary suspensions 14, and at a height smaller than that of the support plane of the body on the bogie 1.

The raised portion 42 of the weight-bearing crosspiece 16 comprises two recesses 40. In each of these extends a stop 26 and an end support 24. The support face 38 of each stop 26 is arranged opposite the support face 32 of the end support 24. The two support faces 38, 32 are parallel when the body of the railway vehicle is not translated or inclined relative to the bogie 1. They are then generally separated by a distance, called stop play, of 20 to 35 mm, for instance. They come into contact with each other when the body is translated and/or inclined relative to the bogie 1. The elastic rivet 36 ensures the progressivity of the reaction of the transversal stress. It can assume different forms, provided that it ensures progressivity of stiffening to crushing.

The arrangement of the limiting device assembly is such that the contact between the support faces 38, 32 is done at a height larger than that of the top of the secondary suspensions 14 and at a height smaller than that of the support plane of the body on the bogie 1. This has the effect of increasing the height of the roll center of the body resting on the bogie.

The motor bogie 1 traditionally comprises a stabilizer bar 44 fastened on either side of the beams 2 and connected by connecting rods 46 at each of its ends to the weight-bearing crosspiece 16. This makes it possible to improve the stability of the bogie, since the secondary suspensions 14 are, relative to the bogie of the state of the art, recentered towards the inside of the bogie 1.

The displacement of the device limiting transversal displacements has two advantages. On one hand, when the recentering of the secondary suspensions at the beams 2 is associated with it, the bulk in the transversal direction is significantly reduced (about 25% less than the bulk of the bogie of the state of the art previously cited), which makes it possible to decrease the bending and torque moments exerted on the frame, due in particular to the off-centering of the load of the secondary suspensions on the lateral extensions of the bogie of the state of the art. The recentering of the secondary suspensions also makes it possible to eliminate the lateral extensions and decrease the mass of the bogie. On the other hand, the height of the roll center is increased, which allows either, at equi-positioning of the secondary suspensions, a gain on the displacements of the body with excess or insufficient superelevation, or, in the case of a recentered secondary suspension completed by a stabilizer bar, as in the embodiment explained here, to obtain the same displacements of the body arranged on a bogie equipped with a limiting device of the state of the art.

The effect of raising the height of the roll center is explained based on FIGS. 4, 5 and 6. In these figures, the parameters used are defined as follows:

Reference O of axes Y-Z defines the roll plane (axis Y) and the reference axis of the track (axis Z), Reference $P_i$ of axes Yp-Zp defines the plane of the bogie frame (bold lines), Reference $S_i$ of axes Ys-Zs defines the plane of the body (double line), M is the most critical point of the body, i.e. the most penalizing regarding the track clearance G imposed by the infrastructure, Dp is the transversal displacement of the bogie frame in the reference O; in the case of a tire bogie, it is the sum of the lateral crushing of the tire and the used guide wheel/new rail lateral play, Ds is the transversal displacement of the body relative to the bogie frame, due to the transversal displacement of the secondary suspension, $\alpha$ is the incline angle of the bogie frame relative to the roll plane Y, $\beta$ is the incline angle of the body relative to the bogie frame, Hs is the height of the axis of rotation of the secondary suspension relative to the roll plane Y, G is the track clearance. It provides the maximum admissible distance from the critical point M of the body relative to the axis Z of the reference track, L is the half-width of the body. FIG. 4 shows a railway vehicle including a body defined by reference $S_1$ with half-width $L_1$ at point M, resting on a bogie of the state of the art defined by reference $P_1$. The device limiting the transversal displacement of the state of the art rests on the bogie frame, between the secondary suspensions 14 and the motor (the limiting device not being shown for clarity reasons). The contact between the stops and the end supports occurs in a plane situated at a height $HS_1$ in reference O, smaller than that of the support plane of the weight-bearing crosspiece 16 on the secondary suspensions 14.

When the railway vehicle enters a curve, or, more simply when it tilts in alignment, the bogie undergoes an incline of angle $\alpha$ and the body undergoes both a transversal displacement Ds and an incline by angle $\beta_1$. The vehicle must respect the track clearance G of the track so as not to come into contact with elements of the infrastructure, whether on a straight portion or a curve. The half-width $L_1$ of the body must therefore be such that the transversal movements caused do not engage the track clearance G.

FIG. 5 shows a railway vehicle including a body defined by reference $S_2$ resting on a bogie defined by reference $P_2$ whereof the positioning of the secondary suspensions 14 is identical to the bogie of FIG. 4, but whereof the device for limiting transversal displacements according to the invention is raised to a height $Hs_2>Hs_1$. $Hs_2$ is greater than the height of the support plane of the weight-bearing crosspiece 16 on the secondary suspensions 14 in reference O. When the vehicle enters a curve, the raising of the height of the axis of rotation of the secondary suspensions results in raising the point around which the body turns. The body undergoes the same lateral displacement Ds and turns by a same angle $\alpha$ as in the case illustrated in FIG. 4: the critical point M is therefore still situated in the same place but it is now remote from the axis of the body Zs by a distance $L_2$ larger than the distance $L_1$ of the case illustrated in FIG. 4 (the axis of the body Zs of the case illustrated in FIG. 4 is indicated in FIG. 5 in double and broken lines). This means that the width of the vehicle can then go to 2 times $L_2$, greater than $L_1$, while still respecting the same track clearance G.

FIG. 6 shows a railway vehicle including a body identical to that of FIG. 5, resting on a bogie defined by reference $P_3$ whereof the device for limiting transversal displacements, according to the invention, remains raised to a height $Hs_2$ greater than the height of the support plane of the weight-bearing crosspiece 16 on the secondary suspensions 14 in the reference P as in FIG. 5. In FIG. 6, the secondary suspensions 14 are brought closer to each other in the transversal direction. The bogie also includes a stabilizer bar 44 and connecting rods 46. The transversal displacement device according to the invention rests on the motor casing, at the distance $Hs_2$ identical to the case illustrated in FIG. 5, and the contact between the stops and the end supports occurs in a plane situated at a height greater than that of the support plane of the weight-bearing crosspiece 16 on the secondary suspensions 14.

When the bogie enters a curve, the body tilts by a different angle $\beta_2$ generally greater than $\beta_1$, as a function of the effectiveness of the stabilizer bar.

This stabilizer bar is defined so that at least the effect of the roll incline of the body by angle $\beta_2$ is not, at point M, greater than the effect obtained in FIG. 4, owing to the fact that the distance $Hs_2$ at point M is larger than the distance $Hs_1$ at point M identical to FIG. 4. The width of the vehicle can then be at least equivalent to $L_1$, while respecting the same track clearance G.

Of course, the invention is in no way limited to the embodiment described and illustrated, which was provided only as an example.

The invention claimed is:

1. A bogie (1) for a railway vehicle having a body, said bogie (1) comprising:

a motor (4) having a casing (6) fastened to two beams (2) of the bogie, a motor shaft (12) being arranged parallel to said beams (2), secondary suspensions (14) and a weight-bearing crosspiece (16) resting on the secondary suspensions (14), an assembly of end supports (24) arranged on the casing (6) of the motor (4) and of stops (26) arranged on the weight-bearing crosspiece (16), said end supports and said stops coming into contact with each other when the body of the railway vehicle is translated or inclined relative to the bogie.

2. The bogie (1) according to claim 1, characterized in that an end support (24) includes a part having a base (28) rigidly fastened on an outer part (30) of the casing (6), and a support face (32) extending in a plane substantially perpendicular to the base (28).

3. The bogie (1) according to claim 1, characterized in that two end supports (24) are rigidly fastened on the outer part (30) of the casing (6) situated above the motor shaft (12).

4. The bogie (1) according to claim 1, characterized in that a stop (26) includes a plate (34) rigidly fastened to a portion (42) of the weight-bearing crosspiece (16) extending in a plane substantially perpendicular to the plane of the weight-bearing crosspiece (16) towards the motor (4), and a rivet (36) made from an elastic material fastened on said plate (34), the rivet (36) having a substantially planar support face (38) substantially parallel to the plate (34).

5. The bogie (1) according to claim 1, characterized in that two stops (26) are rigidly fastened to a portion (42) of the weight-bearing crosspiece (16), said portion (42) being situated above the secondary suspensions (14).

6. The motored bogie (1) according to claim 4, characterized in that the support faces (32) of the end supports (24) are oriented towards an outside of the bogie (1), and in that the support faces (32) of each end support (24) are oriented towards an inside of the bogie (1) such that the support faces (38) of the stops (26) are arranged opposite support faces (32) of the end supports (24).

7. The motored bogie (1) according to claim 1, characterized in that the secondary suspensions (14) are arranged at the beams (2) and substantially in a middle thereof.

8. The motored bogie (1) according to claim 1, characterized in that a stabilizer bar (44) is arranged between the two beams (2) and includes two connecting rods (46) arranged on either side of the beams (2), connected to the weight-bearing crosspiece (16).

9. The bogie (1) according to claim 2, characterized in that two end supports (24) are rigidly fastened on the outer part (30) of the casing (6) situated above the motor shaft (12).

10. The bogie (1) according to claim 4, characterized in that two stops (26) are rigidly fastened to a portion (42) of the weight-bearing crosspiece (16), said portion (42) being situated above the secondary suspensions (14).

11. The motored bogie (1) according to claim 5 characterized in that support faces (32) of the end supports (24) are oriented towards an outside of the bogie (1), and in that the support faces (32) of each end support (24) are oriented towards an inside of the bogie (1) such that the support faces (38) of the stops (26) are arranged opposite support faces (32) of the end supports (24).

12. The motored bogie (1) according to claim 10, characterized in that the support faces (32) of the end supports (24) are oriented towards the outside of the bogie (1), and in that the support faces (32) of each end support (24) are oriented towards the inside of the bogie (1) such that the support faces (38) of the stops (26) are arranged opposite support faces (32) of the end supports (24).

13. The bogie (1) according to claim 1, characterized in that an end support (24) includes an angle bracket having a base (28) rigidly fastened on an outer part (30) of the casing (6), and a support face (32) extending in a plane substantially perpendicular to the base (28).

14. The bogie (1) according to claim 13, characterized in that two end supports (24) are rigidly fastened on the outer part (30) of the casing (6) situated above the motor shaft (12).

15. A bogie (1) for a railway vehicle comprising:

a motor (4) having a casing (6) fastened to two beams (2) of the bogie;

a motor shaft (12) arranged parallel to said beams (2);

secondary suspensions (14) and a weight-bearing crosspiece (16) resting on the secondary suspensions (14); and an assembly of end supports (24) and stops (26) arranged on the casing (6) of the motor (4) and on the weight-bearing crosspiece (16), and wherein one said end support (24) includes a part having a base (28) rigidly fastened on an outer part (30) of the casing (6), and a support face (32) extending in a plane substantially perpendicular to the base (28).

16. The bogie (1) according to claim 15, wherein two end supports (24) are rigidly fastened on the outer part (30) of the casing (6) situated above the motor shaft (12).

17. A bogie (1) for a railway vehicle comprising:

a motor (4) having a casing (6) fastened to two beams (2) of the bogie;

a motor shaft (12) being arranged parallel to said beams (2);

secondary suspensions (14) and a weight-bearing crosspiece (16) resting on the secondary suspensions (14); and an assembly of end supports (24) and stops (26) arranged on the casing (6) of the motor (4) and on the weight-bearing crosspiece (16), wherein one of said stops (26) includes a plate (34) rigidly fastened to a portion (42) of the weight-bearing crosspiece (16) extending in a plane substantially perpendicular to the plane of the weight-bearing crosspiece (16) towards the motor (4), and a rivet (36) made from an elastic material fastened on said plate (34), the rivet (36) having a substantially planar support face (38) substantially parallel to the plate (34).

18. The motored bogie (1) according to claim 17, wherein the support faces (32) of the end supports (24) are oriented towards an outside of the bogie (1), and in that the support faces (32) of each end support (24) are oriented towards an inside of the bogie (1) such that the support faces (38) of the stops (26) are arranged opposite support faces (32) of the end supports (24).

19. The bogie (1) according to claim 17, wherein two stops (26) are rigidly fastened to a portion (42) of the weight-bearing crosspiece (16), said portion (42) being situated above the secondary suspensions (14).

20. The motored bogie (1) according to claim 19, wherein the support faces (32) of the end supports (24) are oriented towards the outside of the bogie (1), and the support faces (32) of each end support (24) are oriented towards the inside of the bogie (1) such that the support faces (38) of the stops (26) are arranged opposite support faces (32) of the end supports (24).

* * * * *